US009258655B2

(12) United States Patent
Bäuml et al.

(10) Patent No.: US 9,258,655 B2
(45) Date of Patent: Feb. 9, 2016

(54) METHOD AND DEVICE FOR FREQUENCY COMPRESSION WITH HARMONIC CORRECTION

(75) Inventors: Robert Bäuml, Eckental (DE); Ulrich Kornagel, Erlangen (DE); Thomas Pilgrim, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 1105 days.

(21) Appl. No.: 13/248,157

(22) Filed: Sep. 29, 2011

(65) Prior Publication Data

US 2012/0076332 A1 Mar. 29, 2012

(30) Foreign Application Priority Data

Sep. 29, 2010 (DE) ..... 10 2010 041 644

(51) Int. Cl.
*H04R 25/00* (2006.01)

(52) U.S. Cl.
CPC ..... *H04R 25/353* (2013.01); *H04R 2225/43* (2013.01)

(58) Field of Classification Search
CPC .. H04R 2225/43; H04R 25/353; G10L 21/00; G10L 19/0204
USPC ..... 381/316, 94.3, 98, 312, 320; 700/94
See application file for complete search history.

(56) References Cited

U.S. PATENT DOCUMENTS

| | | | | |
|---|---|---|---|---|
| 3,634,625 | A * | 1/1972 | Geohegan et al. | 381/54 |
| 4,051,331 | A * | 9/1977 | Strong et al. | 381/320 |
| 4,637,402 | A * | 1/1987 | Adelman | 600/559 |
| 5,285,144 | A * | 2/1994 | Hsu | H02P 7/00 318/807 |
| 6,577,739 | B1 | 6/2003 | Hurtig et al. | |
| 7,003,120 | B1 * | 2/2006 | Smith et al. | 381/61 |
| 2004/0264721 | A1 * | 12/2004 | Allegro et al. | 381/316 |
| 2009/0312820 | A1 * | 12/2009 | Nie et al. | 607/57 |
| 2011/0150256 | A1 | 6/2011 | Baechler et al. | |

FOREIGN PATENT DOCUMENTS

| | | | |
|---|---|---|---|
| DE | 2613513 | A1 | 10/1977 |
| WO | 2009143898 | A1 | 12/2009 |

* cited by examiner

*Primary Examiner* — Fan Tsang
*Assistant Examiner* — Eugene Zhao
(74) *Attorney, Agent, or Firm* — Laurence A. Greenberg; Werner H. Stemer; Ralph E. Locher

(57) ABSTRACT

Artifacts occurring during frequency compression, in particular in the case of hearing aids, are avoided or reduced. The method compresses the frequency of an audio signal having a fundamental frequency and at least one harmonic. The audio signal is provided in a plurality of frequency channels. The harmonic of the audio signal is shifted or mapped from a first frequency channel of the plurality of frequency channels into a second frequency channel. In addition a frequency which is likewise harmonic with respect to the fundamental frequency is estimated in the second frequency channel, the harmonic being shifted or mapped onto the estimated frequency. As a result the harmonic pattern is preserved in the compressed signal and the artifacts are reduced.

9 Claims, 3 Drawing Sheets

METHOD AND DEVICE FOR FREQUENCY COMPRESSION WITH HARMONIC CORRECTION

CROSS-REFERENCE TO RELATED APPLICATION

This application claims the priority, under 35 U.S.C. §119, of German patent application DE 10 2010 041 644.4, filed Sep. 29, 2010; the prior application is herewith incorporated by reference in its entirety.

BACKGROUND OF THE INVENTION

Field of the Invention

The present invention relates to a method for compressing the frequency of an audio signal having a fundamental frequency and at least one harmonic by providing the audio signal in a plurality of frequency channels and shifting or mapping the harmonic of the audio signal from a first frequency channel of the plurality of frequency channels into a second frequency channel of the plurality of frequency channels. In addition the present invention relates to a corresponding device for frequency compression. A device of that kind can be used in particular in a hearing apparatus. In the present context a hearing apparatus is understood to mean any sound-emitting device that can be worn in or on the ear, in particular a hearing aid, a headset, headphones and the like.

Hearing aids are wearable hearing apparatuses which serve to provide hearing assistance to the hearing-impaired. In order to accommodate the multiplicity of individual requirements, hearing aids are provided in different designs, including behind-the-ear (BTE) hearing aids, hearing aids with external earpiece (RIC: Receiver In the Canal) and in-the-ear (ITE) hearing aids, e.g. including concha hearing aids or canal (ITE, CIC) hearing aids. The hearing aids cited by way of example are worn on the outer ear or in the auditory canal. In addition, however, bone conduction hearing aids and implantable or vibrotactile hearing aids are also commercially available. With these devices the damaged hearing is stimulated either mechanically or electrically.

Basically, hearing aids have as their main components an input transducer, an amplifier and an output transducer. The input transducer is generally a sound receiver, e.g. a microphone, and/or an electromagnetic receiver, e.g. an induction coil. The output transducer is mostly realized as an electroacoustic transducer, e.g. a miniature loudspeaker, or as an electromechanical transducer, e.g. a bone conduction earpiece. The amplifier is typically integrated into a signal processing unit.

This basic layout is illustrated in FIG. 1 with reference to an exemplary behind-the-ear hearing aid. A hearing aid housing 1 that is designed to be worn behind the ear has incorporated into it one or more microphones 2 for recording ambient sound. A signal processing unit (SPU) 3 which is also integrated into the hearing aid housing 1 processes the microphone signals and amplifies them. The output signal from the signal processing unit 3 is transmitted to a loudspeaker or earpiece 4 which emits an acoustic signal. The sound is transmitted to the hearing aid wearer's eardrum, where appropriate by way of a sound tube that is fixed in the auditory canal by means of an earmold. The hearing aid and in particular the signal processing unit 3 are supplied with power by means of a battery (BAT) 5 that is likewise integrated into the hearing aid housing 1.

Many forms of hearing loss can be compensated by way of frequency-dependent amplification in combination with dynamic compression. There are, however, forms of hearing loss in which amplification has no effect or is disadvantageous. An example of this are forms of hearing loss characterized by so-called "dead regions". Dead regions are frequency ranges in which it is no longer possible to make spectral components audible by way of amplification.

A possible technique for dealing with the above problem is frequency compression. With this approach spectral components from a source frequency range which typically lies at higher frequencies and in which no amplification is to be applied (e.g. dead region) are shifted into a lower-lying target frequency range. In the target frequency range audibility is usually guaranteed in principle, for which reason an amplification can be applied.

Hearing aids are known which support frequency compression of this kind. In the compression method the properties of a filter bank, for example, are used for a simple implementation. Individual channels are selectively copied, inter alia as a function of their instantaneous power, onto other channels so that the frequency components contained in these channels reappear, shifted at the output, in a different frequency range. An adjustable mapping rule determines where the channels are mapped to, with the result that different compression ratios can be realized.

FIG. 2 shows the principle of frequency compression by simple copying of channels, a technique this is already used for hearing aids. For example, a channel 14' (characterized by its mid-band frequency 14) is copied or shifted onto a channel 11' (characterized by its mid-band frequency 11). Located in the channel 14' is a tone 14" (e.g. a harmonic) which is shifted onto the tone 11" in the target channel 11'. The distance of the tone 14" from the mid-band frequency 14 is identical to the distance of the tone 11" from the mid-band frequency 11.

This simple mapping rule is attended by problems in relation to harmonic signals. Harmonic signals occur e.g. in voiced sounds in speech, in vowels for example. In this case the uncompressed spectrum has a linear-like structure, with spectral lines occurring at the voice fundamental frequency and at its integral multiples. With the simple mapping rule according to the prior art, the pattern of the harmonic signals (line structure) is not taken into account and is therefore destroyed, i.e. the spectral lines are no longer guaranteed to occur on an integral multiple of the voice fundamental frequency. This expresses itself in clearly discernible artifacts (signal components which occur at integral multiples of the fundamental frequency are referred to in the present context as "harmonic" for short).

SUMMARY OF THE INVENTION

It is accordingly an object of the invention to provide a method and device for frequency compression with harmonic correction which overcome the above-mentioned disadvantages of the heretofore-known devices and methods of this general type and which provides for a system in which artifacts occurring during frequency compression are further reduced.

With the foregoing and other objects in view there is provided, in accordance with the invention, a method for compressing a frequency of an audio signal, the audio signal having a fundamental frequency and at least one harmonic. The novel method comprises the following steps:

providing the audio signal in a plurality of frequency channels, the frequency channels including a first frequency channel and a second frequency channel;

estimating a first frequency in the second frequency channel that is likewise a harmonic of the fundamental frequency; and shifting or mapping the at least one harmonic of the audio signal from the first frequency channel into the second frequency channel by shifting or mapping the at least one harmonic onto the estimated first frequency.

In other words, the objects of the invention are achieved by a method for compressing the frequency of an audio signal having a fundamental frequency and at least one harmonic, by:

providing the audio signal in a plurality of frequency channels and shifting or mapping the harmonic of the audio signal from a first frequency channel of the plurality of frequency channels into a second frequency channel of the plurality of frequency channels, and estimating a first frequency which is likewise harmonic with respect to the fundamental frequency in the second frequency channel, wherein the harmonic is shifted or mapped onto the estimated first frequency.

With the above and other objects in view there is also provided, in accordance with the invention, a device for compressing a frequency of an audio signal, the audio signal having a fundamental frequency and at least one harmonic, the device comprising:

a signal processing unit for providing the audio signal in a plurality of frequency channels, the plurality of frequency channels including a first frequency channel and a second frequency channel; and a shifting unit for shifting or mapping the harmonic of the audio signal from the first frequency channel into the second frequency channel of the plurality of frequency channels; and an estimating unit for estimating a first frequency which is likewise harmonic with respect to the fundamental frequency in the second frequency channel;

wherein the shifting unit is configured to shift of map the harmonic onto the first frequency estimated by the estimating unit.

A harmonic correction is advantageously performed during or after the shifting or mapping of the harmonic into another frequency channel. This means that the harmonic is placed onto a frequency position which likewise represents an integral multiple of the fundamental frequency. Even after the shift the harmonic therefore still represents a harmonic. This reduces the artifacts significantly.

In accordance with an added feature of the invention, the first frequency channel is shifted completely into the second frequency channel. This enables for example a frequency channel from a dead region to be shifted into an audible range of a hearing aid wearer. If a harmonic is present in the first frequency channel, it will be shifted completely with the frequency channel. In the process its distance from the mid-band frequency of the channel remains initially unchanged.

A second frequency assigned to the harmonic that is shifted with the frequency channel can be estimated and the shifted harmonic can then be shifted further onto the first frequency in the second frequency channel. This means that the shifting takes place in two steps. First the entire frequency channel is shifted and then the original harmonic is shifted again within the frequency channel onto a harmonic frequency position.

The further shifting onto the first frequency in the second shifting step can be effected for example by means of amplitude modulation. This can be realized in the time domain by means of a simple multiplication by a factor $\exp(j\cdot\omega\cdot t)$.

The harmonic in the first frequency channel preferably represents a dominant frequency. This allows its position before and after shifting to be estimated relatively accurately.

In accordance with an alternative embodiment of the invention, the harmonic is mapped onto the estimated first frequency in that a signal generated synthetically in the second frequency channel receives the amplitude of the harmonic in the first frequency channel and the estimated frequency of the second frequency channel. In this case there is therefore no need for a second shifting step to be performed, by means of amplitude modulation for example, since a synthetic signal is used at the appropriate harmonic position. However, this has the disadvantage that phase information may be lost under certain conditions.

The frequency compression device according to the invention has a signal processing unit which preferably has a polyphase filter bank. By this means it is possible to generate only positive frequency components in the channels.

The device according to the invention is particularly advantageously used in a hearing apparatus and in particular in a hearing aid. This enables frequency compression to be realized with fewer artifacts for hearing aid wearers.

Other features which are considered as characteristic for the invention are set forth in the appended claims.

Although the invention is illustrated and described herein as embodied in a method for frequency compression with harmonic correction and device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments described in greater detail below represent preferred exemplary embodiments of the present invention.

For a better understanding of the invention, however, frequency compression according to the prior art will first be explained in detail with reference to FIG. 3. There, frequencies conforming to a frequency mapping curve (e.g. SPINC, BARK, etc.) are compressed. The starting point, by way of example, is a line spectrum, as represented in the top part of FIG. 3. The amplitude response $\alpha$ is plotted against the frequency f. The line spectrum has numerous harmonics 20 that form the spectral fine structure of the harmonic signal. The amplitudes of the harmonics 20 can be combined by means of a spectral envelope 21. The spacing $f_0$ between two harmonics 20 corresponds to the fundamental frequency in the entire spectral range. The aim is now to compress the spectrum above a frequency $f_c$. The compression is carried out channel by channel in that selected channels of the original spectrum are copied into lower-lying channels. However, the channels generally have a different bandwidth than the spacing $f_0$ between the harmonics. As a result thereof, in the course of the shifting the harmonics 20 land on frequency positions outside the line pattern shown in the top part of FIG. 3.

Figure 3:
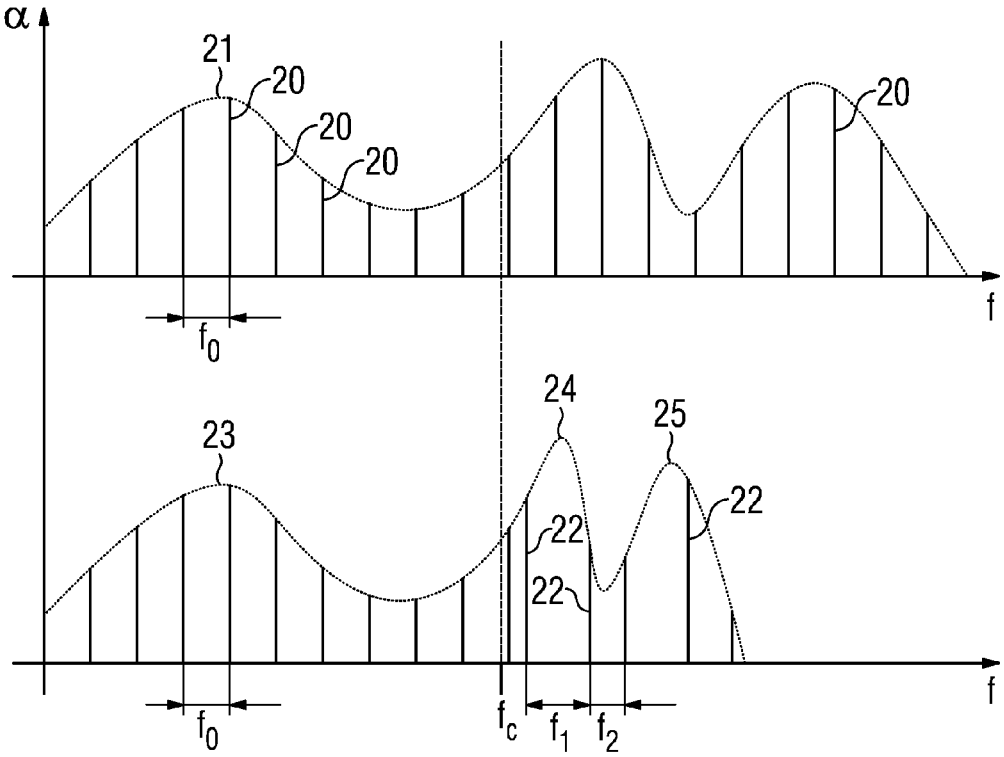
FIG 3 (Prior art)
FIG. 3 shows an example of compression according to the prior art.

The bottom part of FIG. 3 shows a compressed spectrum of that type. The spacings $f_1$, $f_2$ between the individual lines 22 which represent the shifted harmonics are no longer constant and in particular are not equal to $f_0$. Although in the compressed range the envelope 23 of the compressed spectrum shows the shifted formants 24 and 25, as they appear from the original spectrum, the distance between the lines 22 is not uniform, so as a result thereof the spectral fine structure and hence the structure of the harmonic signal are destroyed. Corresponding artifacts are the consequence.

A significant improvement in particular for voice signals can be achieved if a harmonic correction is performed in addition to the simple mapping rule according to the prior art. This is illustrated, and explained in more detail, with reference to FIG. 4. In the top part of the figure the original spectrum with its harmonics 20 and the envelope 21 is shown once again as in the top part of FIG. 3. Over the entire original spectrum the spacing of the individual harmonics 20 corresponds to the fundamental frequency $f_0$.

Figure 4:
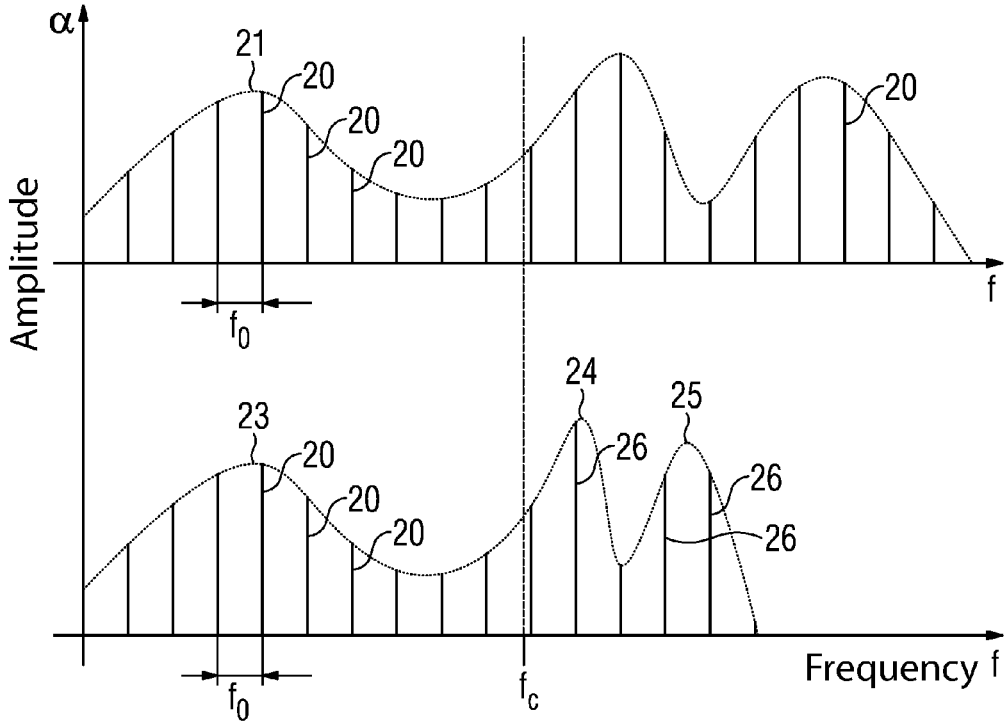
FIG. 4 shows an example of compression according to the present invention.

The object sought to be achieved by way of the invention is shown in an exemplary manner in the bottom part of FIG. 4. The spectrum is compressed above the cutoff frequency $f_c$. The envelope 23 of the compressed spectrum possesses the same shape as that shown in the bottom part of FIG. 3. In other words the formants 24 and 25 can also be identified in the compressed range. The lines 26 of the spectrum in the compressed range above $f_c$ have the same spacing $f_0$ relative to one another as the lines or harmonics 20 in the uncompressed range. This means that the fine structure of the spectrum of the harmonic signal is untouched by the compression. Accordingly fewer artifacts are generated.

Figure 5:
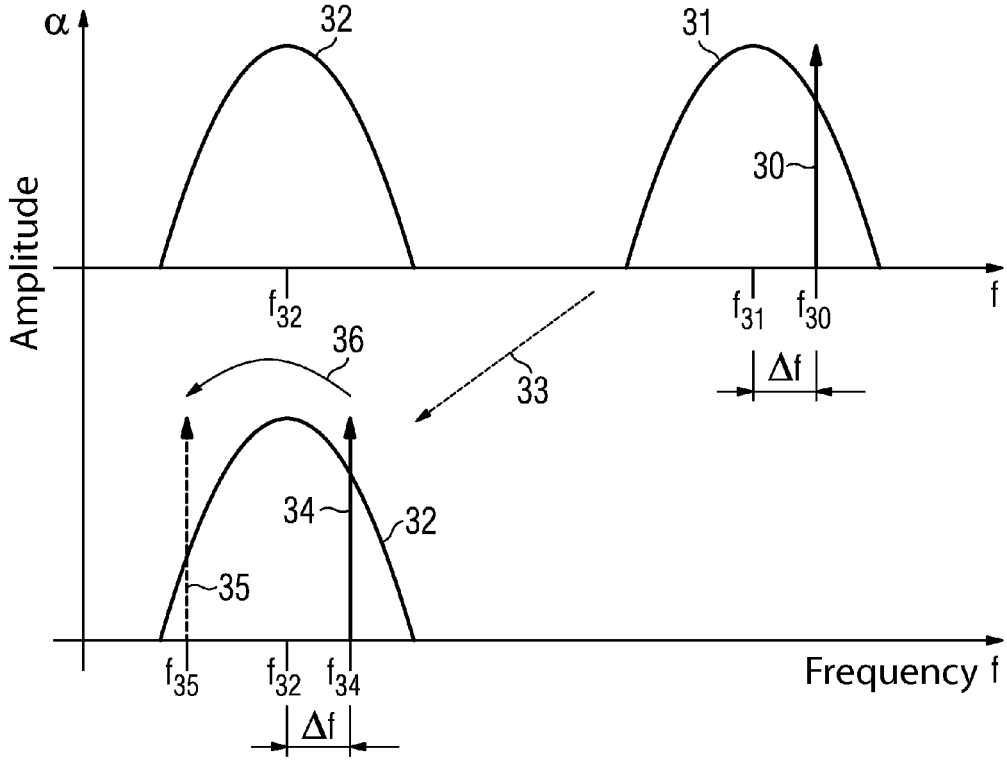
FIG. 5 shows a section of an uncompressed spectrum and a section of a compressed spectrum.

For the purpose of frequency compression with harmonic correction the frequency structure of the harmonic pattern of the uncompressed signal is first estimated, i.e. the positions of the harmonics in the frequency range are determined. This shall be explained in more detail with reference to FIG. 5, which again shows a section of an uncompressed spectrum above and a section of a compressed spectrum below. In this case the section of the spectrum shown has a line or harmonic 30. This lies in a frequency channel 31 which for its part has a mid-band frequency $f_{31}$. Located below the first frequency channel 31 is a second frequency channel 32 which has the mid-band frequency $f_{32}$. For compression purposes the first frequency channel 31 is now shifted, copied or mapped onto the second frequency channel 32. This represents a first step 33 in the frequency compression. Said step 33 corresponds to the prior art compression as shown in FIG. 3. According thereto the harmonic 30 of the first frequency channel 31 is shifted onto the line 34 to which a frequency $f_{34}$ is assigned (henceforth also referred to as the second frequency). The distance $\Delta f$ between the frequencies $f_{31}$ and $f_{30}$ is identical to the distance between the frequencies $f_{32}$ and $f_{34}$. However, the frequency $f_{34}$ does not correspond to a harmonic of the fundamental frequency. Rather, a harmonic would lie at the frequency position $f_{35}$ in the second frequency channel 32. This can be determined for example by means of a first frequency estimation in the target frequency range, i.e. in the second frequency channel 32 onto which the first frequency channel 31 is mapped or shifted. The line 34 must therefore be shifted onto the frequency $f_{35}$ in order to obtain the fine structure of the harmonic signal. To that end the frequency structure of the still uncorrected compressed spectral components is estimated in a second estimation. In the simplified example of FIG. 5, in which only one channel is shifted, the frequency $f_{34}$ of the line 34 is therefore estimated or determined after the shift in the first step 33. The frequency offset, i.e. the distance between the frequencies $f_{34}$ and $f_{35}$, can be determined from the two frequency estimations. The offset is compensated for with the aid of a modulation in a second step 36, wherein the harmonic pattern is restored. In this case the line 34 is shifted onto the frequency $f_{35}$, producing the line 35 as a result.

The modulation can be achieved for example on the basis of the analytical signal through multiplication by a suitable complex twiddle factor. Thus, the shift by an angular frequency $\omega\mathbf{1}$ corresponds to a multiplication by the factor $\exp(j\cdot\omega\mathbf{1}\cdot t)$. The resulting modulation corresponds to an amplitude modulation.

This method can advantageously be used in the case of a polyphase filter bank which only generates the complex-valued analytical signal (only positive frequency component of a Fourier transform) in the channels. With this approach, by means of modulation using the modulation term $\exp(j\cdot\omega\mathbf{1}\cdot t)$, each channel can be modulated cyclically, with the result that the frequency components are shifted therein correspondingly cyclically by the angular frequency $\omega\mathbf{1}$.

Basically, two cases need to be distinguished in the estimation of the (dominant) frequency:

- A dominant frequency exists which can be readily estimated, i.e. a strong tonal component exists in this channel. This enables a good correction of the harmonic pattern to be achieved.
- No dominant frequency exists, i.e. the signal in the channel is noise-like. The frequency estimation leads to a more or less random instantaneous frequency. During mapping onto a target frequency this leads in turn to a phase randomization or random modulation in the channel, which in the case of noise-like channels has scarcely any effect on the hearing impression.

The exemplary embodiment described above is based on the assumption that the harmonic 30 is actually shifted as a signal component of the audio signal. According to an alternative embodiment variant the compressed spectral components are generated half-synthetically. The information relating to the frequency position of the half-synthetically generated spectral components is acquired from the estimation of the uncompressed harmonic structure, i.e. the frequency 35 is determined as in the above example. However, a synthetic signal is now generated at the frequency $f_{35}$. The amplitude of said synthetic signal is adjusted such that it corresponds to the amplitude of the original harmonic 30, i.e. the associated amplitude is obtained from the source spectrum. By this means, too, a frequency compression can be achieved in which the harmonic pattern is preserved.

The source frequency to target frequency mapping rule for frequency compression is applied in the known manner in audiology. The harmonic correction or, as the case may be, the preservation of the harmonic structure of the compressed spectral components is then achieved according to the invention. As a result the artifacts that result from the simple mapping rule according to the prior art are substantially reduced.

Figure 1:
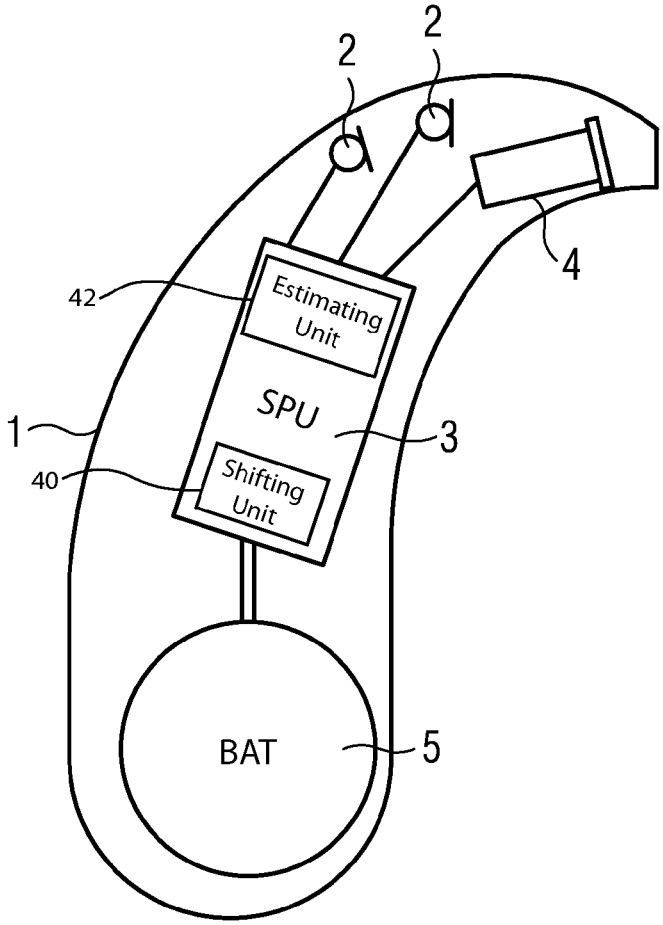
FIG 1 PRIOR ART
FIG. 1 shows the basic design of a hearing aid according to the prior art.
Figure 2:
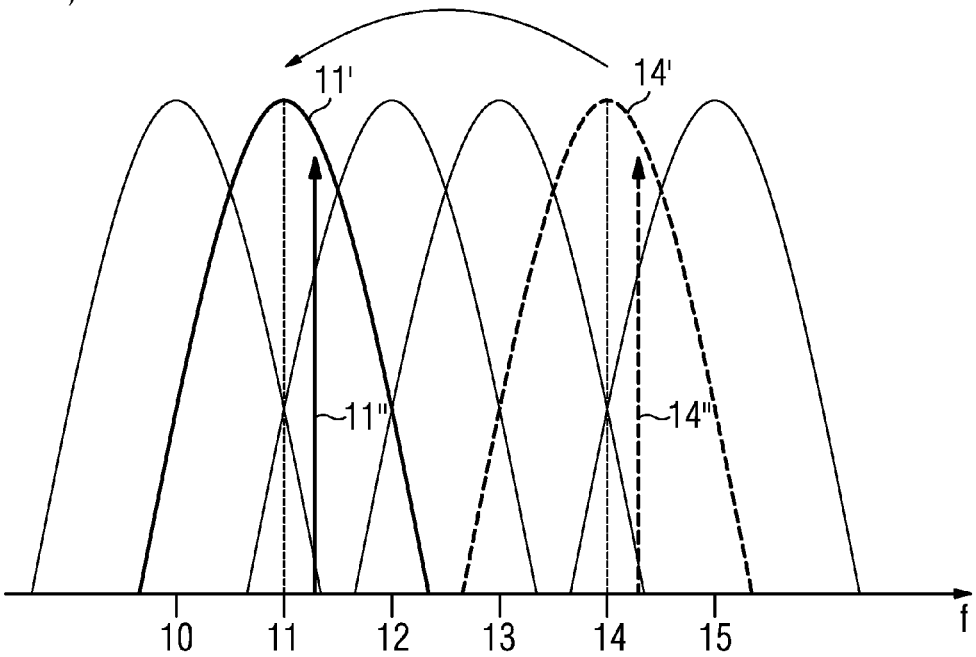
FIG 2 (Prior art)
FIG. 2 shows the principle of frequency compression by simple copying of channels according to the prior art.

The shifting unit 40 and the estimating unit 42 are shown in FIG. 1.

The invention claimed is:

1. A method for compressing a spectrum of an audio signal, the audio signal having a fundamental frequency and at least one harmonic of the fundamental frequency, the method which comprises:

providing the spectrum of the audio signal in a plurality of frequency channels, the frequency channels including a first frequency channel and a second frequency channel, wherein the spectrum of the audio signal extends over the first frequency channel and over the second frequency channel, and wherein said at least one harmonic is located in the first frequency channel;

estimating a first frequency in the second frequency channel that is another harmonic of the fundamental frequency; and shifting or mapping said at least one harmonic of the audio signal from the first frequency channel into the second frequency channel by shifting or mapping said at least one harmonic onto the estimated first frequency.

2. The method according to claim 1, which comprises shifting the first frequency channel completely into the second frequency channel.

3. The method according to claim 2, which comprises estimating a second frequency assigned to said at least one harmonic after having shifted the first frequency channel completely into the second frequency channel, calculating a distance between the first frequency and the second frequency, and further shifting said at least one harmonic shifted in the second frequency channel onto the first frequency based on said calculated distance.

4. The method according to claim 3, wherein the step of further shifting onto the first frequency is accomplished by way of amplitude modulation.

5. The method according to claim 1, wherein the harmonic in the first frequency channel represents a dominant frequency.

6. The method according to claim 1, which comprises mapping the harmonic onto the estimated first frequency by assigning a signal generated synthetically in the second frequency channel an amplitude of the harmonic in the first frequency channel.

7. A device for compressing a spectrum of an audio signal, the audio signal having a fundamental frequency and at least one harmonic of the fundamental frequency, the device comprising:

a signal processing unit for providing the spectrum of the audio signal in a plurality of frequency channels, the plurality of frequency channels including a first frequency channel and a second frequency channel, wherein the spectrum of the audio signal extends over the first frequency channel and over the second frequency channel, and wherein said at least one harmonic is located in the first frequency channel; and said signal processing unit including a shifting unit for shifting or mapping said at least one harmonic of the audio signal from the first frequency channel into the second frequency channel of the plurality of frequency channels; and said signal processing unit including an estimating unit for estimating a first frequency which is another harmonic of the fundamental frequency in the second frequency channel;

wherein said shifting unit is configured to shift of map said at least one harmonic onto the first frequency estimated by said estimating unit.

8. The device as claimed in claim 7, wherein said signal processing unit comprises a polyphase filter bank.

9. A hearing apparatus, comprising a device according to claim 7 configured to receive the audio signal, to process the audio signal, and to output a processed audio signal as an output signal of the hearing apparatus.

* * * * *